US009568030B2

(12) United States Patent
Gorman et al.

(10) Patent No.: US 9,568,030 B2
(45) Date of Patent: Feb. 14, 2017

(54) SYSTEM AND METHOD FOR MANAGING MACHINE POWER SYSTEM

(71) Applicant: Caterpillar Inc., Peoria, IL (US)

(72) Inventors: Corey L. Gorman, Peoria, IL (US); Adam Nackers, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 333 days.

(21) Appl. No.: 14/223,386

(22) Filed: Mar. 24, 2014

(65) Prior Publication Data

US 2015/0267719 A1 Sep. 24, 2015

(51) Int. Cl.

| | |
|---|---|
| ***F15B 19/00*** | (2006.01) |
| ***E02F 9/20*** | (2006.01) |
| ***E02F 9/22*** | (2006.01) |
| *E02F 3/32* | (2006.01) |
| *E02F 9/26* | (2006.01) |

(52) U.S. Cl.

CPC ..... *F15B 19/005* (2013.01); *E02F 9/2066* (2013.01); *E02F 9/2292* (2013.01); *F15B 19/007* (2013.01); *E02F 3/32* (2013.01); *E02F 9/265* (2013.01); *F15B 2211/50518* (2013.01); *F15B 2211/633* (2013.01); *F15B 2211/634* (2013.01); *F15B 2211/6309* (2013.01); *F15B 2211/6346* (2013.01); *F15B 2211/6651* (2013.01); *F15B 2211/6652* (2013.01); *F15B 2211/6655* (2013.01); *F15B 2211/6658* (2013.01); *F15B 2211/857* (2013.01); *F15B 2211/8643* (2013.01); *F15B 2211/88* (2013.01)

(58) Field of Classification Search

CPC ..... F15B 19/005; F15B 19/007; E02F 9/265

USPC ..... 60/431; 701/50

See application file for complete search history.

(56) References Cited

U.S. PATENT DOCUMENTS

| | | | | |
|---|---|---|---|---|
| 5,768,811 | A | 6/1998 | Cooper | |
| 5,999,872 | A | 12/1999 | Kinugawa et al. | |
| 6,681,877 | B2 | 1/2004 | Ono et al. | |
| 6,856,878 | B2 * | 2/2005 | Braunhardt | A01B 63/00 56/10.2 R |
| 7,565,230 | B2 * | 7/2009 | Gardner | G09B 9/052 180/272 |
| 8,364,440 | B2 | 1/2013 | Putkonen | |

(Continued)

FOREIGN PATENT DOCUMENTS

| | | |
|---|---|---|
| JP | 11293710 | 10/1999 |
| JP | 11293710 A * | 10/1999 |

(Continued)

*Primary Examiner* — Thomas E Lazo

(74) *Attorney, Agent, or Firm* — Caterpillar Inc.; James Bennin

(57) ABSTRACT

A power system for a machine is provided. The power system includes an operator interface for entering an operator command relating to one or more functions of the machine. The power system includes a hydraulic pump and an engine configured to provide power to the hydraulic device. A controller is in communication with the operator interface, the hydraulic device and the engine. The controller is configured to consider operator skill level information relating to a skill level of the operator of the machine and to determine at least one desired power system operating parameter based on the operator command and the operator skill level information and to adjust at least one of the hydraulic pump and the engine based on the desired power system operating parameter.

18 Claims, 3 Drawing Sheets

(56) References Cited

U.S. PATENT DOCUMENTS

| | | | | |
|---|---|---|---|---|
| 2009/0299707 | A1* | 12/2009 | Putkonen | G06Q 10/06 703/2 |
| 2012/0001876 | A1* | 1/2012 | Chervenka | G09G 5/00 345/204 |
| 2012/0323453 | A1 | 12/2012 | Havimäki et al. | |

FOREIGN PATENT DOCUMENTS

| | | | |
|---|---|---|---|
| JP | 2003194017 | | 7/2003 |
| JP | 2003194017 | A * | 7/2003 |
| JP | 2011241677 | | 12/2011 |

* cited by examiner

SYSTEM AND METHOD FOR MANAGING MACHINE POWER SYSTEM

TECHNICAL FIELD

This patent disclosure relates generally to power systems for machines and, more particularly, to systems and methods for managing a power system of a machine.

BACKGROUND

Machines may include one or more power systems to drive one or more loads. The load may be a work implement on the machine or it may be a drive component that provides propulsion for the machine itself. The power system may include one or more power sources which may include engines, batteries and any other suitable energy generating or energy storage devices. The power system may have an associated control system that monitors various operating parameters of the power system and provides output signals to various systems in order to help the power system operate more efficiently.

The control system may also receive signals from an operator of the machine that may be entered through one or more operator input devices. The control system may then use those operator inputs to help direct operation of the power system. Unfortunately, however, many operators, due to a lack of training or experience, will often direct a machine operating mode that does not match the intended utilization of the machine. For example, when operators are presented with a number of different power system operating modes, they seldom reduce the power system from the setting that produces the highest horsepower. This can lead to mismatches between the power system setting and the work cycle being performed by the machine. In particular, it can lead to situations where the power system is producing more power than is reasonably necessary to perform a given work cycle. For instance, the power system may not need to operate in a high horsepower mode when it is being called upon to do relatively lighter jobs, such as driving a work implement that is digging in soft ground. This mismatch between the operation of the power source and the intended utilization of the machine can lead to higher fuel or fluid consumption without any corresponding incremental productivity increase as well other effects such as increased wear on machine components and increased strain on the machine operator.

U.S. Pat. No. 8,364,440 discloses a system and method for evaluating the productivity of a working machine and its operator in a real or virtual working environment. The system includes the capability of providing feedback to the operator and instructions on how to achieve better productivity in operating the machine. The system can also provide comparisons between different operators of the machine. The system, however, does not adjust the operation of the machine in any way in response to the data produced concerning the productivity of the machine.

SUMMARY

In one aspect, the disclosure describes a power system for a machine including an operator interface for entering an operator command relating to one or more functions of the machine. The power system includes a hydraulic pump and an engine configured to provide power to the hydraulic device. A controller is in communication with the operator interface, the hydraulic device and the engine. The controller is configured to consider operator skill level information relating to a skill level of the operator of the machine and to determine at least one desired power system operating parameter based on the operator command and the operator skill level information and to adjust at least one of the hydraulic pump and the engine based on the desired power system operating parameter.

In another aspect, the disclosure describes a method for managing a power system of a machine. The method includes the step of receiving an operator command through an operator interface. Information is collected relating to a skill level of an operator of the machine. At least one desired power system operating parameter is determined based on the operator command and the operator skill level information. An engine or hydraulic device of the power system is adjusted based on the desired power system operating parameter.

In yet another aspect, the disclosure describes a machine including an operator interface for entering operator commands relating to one or more functions of the machine. The machine includes a work implement and a hydraulic pump for driving movement of the work implement and an engine configured to provide power to the hydraulic device. A controller is in communication with the operator interface, the hydraulic device and the engine. The controller is configured to consider operator skill level information relating to a skill level of the operator of the machine and to consider machine utilization information relating to utilization of the machine, and to determine at least one desired power system operating parameter based on the operator commands, the operator skill level information and the utilization information and to adjust at least one of the hydraulic device and the engine based on the desired power system operating parameter.

DETAILED DESCRIPTION

Figure 1:
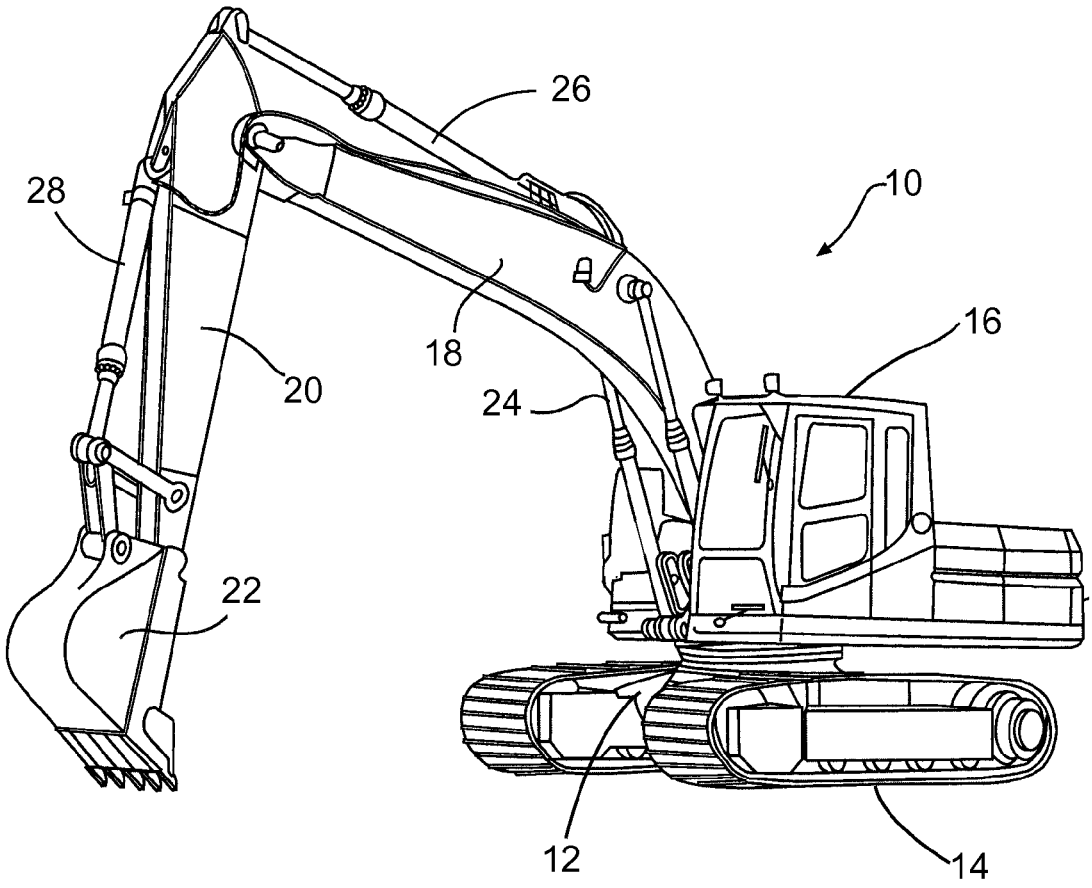
FIG. 1 is a schematic perspective view of an exemplary machine suitable for use with a system and method for managing a power system according to the present disclosure.

This disclosure generally relates to a system and method for managing a power system of a machine. FIG. 1 shows an exemplary embodiment of a machine 10 for performing work. In particular, the exemplary machine 10 shown in FIG. 1 is an excavator for performing operations such as digging and/or loading material. Although the exemplary systems and methods disclosed herein are described in relation to an excavator, the disclosed systems and methods have applications in other machines such as an automobile, truck, agricultural vehicle, work vehicle, wheel loader, dozer, loader, track-type tractor, grader, off-highway truck, or any other machines known to those skilled in the art. In this regard, the term "machine" may refer to any machine with a hydraulically powered work implement that performs some type of operation associated with an industry such as mining, construction, farming, transportation, or any other industry known in the art.

As shown in FIG. 1, the exemplary machine 10 includes a chassis 12 flanked by ground-engaging members 14 for moving the machine 10 (e.g., via ground-engaging tracks or wheels). The machine 10 includes an operator cab 16 mounted to the chassis 12 in a manner that permits rotation of the cab 16 with respect to the chassis 12. The work implement in the illustrated embodiment comprises a boom 18, a stick 20 and a bucket 22. The boom 18 is coupled to the cab 16 in a manner that permits the boom 18 to pivot with respect to the cab 16. At an end opposite the cab 16, the stick 20 is coupled to the boom 18. The stick 20 is mounted so as to be pivotable with respect to the boom 18. The digging implement or bucket 22 is pivotably coupled to the stick 20. Although exemplary machine 10 shown in FIG. 1 includes a bucket, other tools may be coupled to the stick 20 when other types of work are desired to be performed.

In the exemplary embodiment shown, a pair of actuators 24 are coupled to the cab 16 and boom 18 in order to raise and lower the boom 18 relative to cab 16. Additionally, an actuator 26 is coupled to the boom 18 and the stick 20. Extension and retraction of the actuator 26 can pivot the stick 20 inward and outward with respect to the boom 18. A further actuator 28 is coupled to stick 20 and the bucket 22, such that extension and retraction of actuator 28 results in the digging implement or bucket 22 pivoting between closed and open positions, respectively, with respect to the stick 20. As explained in more detail with respect to FIG. 2, the actuators 24, 26, and 28 may be hydraulic devices, in particular, hydraulic actuators powered by supplying and draining fluid from the cylinders on either side of a piston to cause reciprocating movement of the piston within the cylinder. While the illustrated embodiment includes hydraulic actuators, it will be understood that one or more of the actuators 24, 26, and 28 may be non-hydraulic actuators. Moreover, the number of actuators 24, 26, and 28 coupled to boom 18, stick 20, and/or implement 22 may be different than shown in FIG. 1. One or more of the hydraulic actuators also may comprise any device configured to receive pressurized hydraulic fluid and convert it into a mechanical force and motion. For example, one or more of the hydraulic actuators 20 may additionally or alternatively include a fluid motor or hydrostatic drive train.

Figure 2:
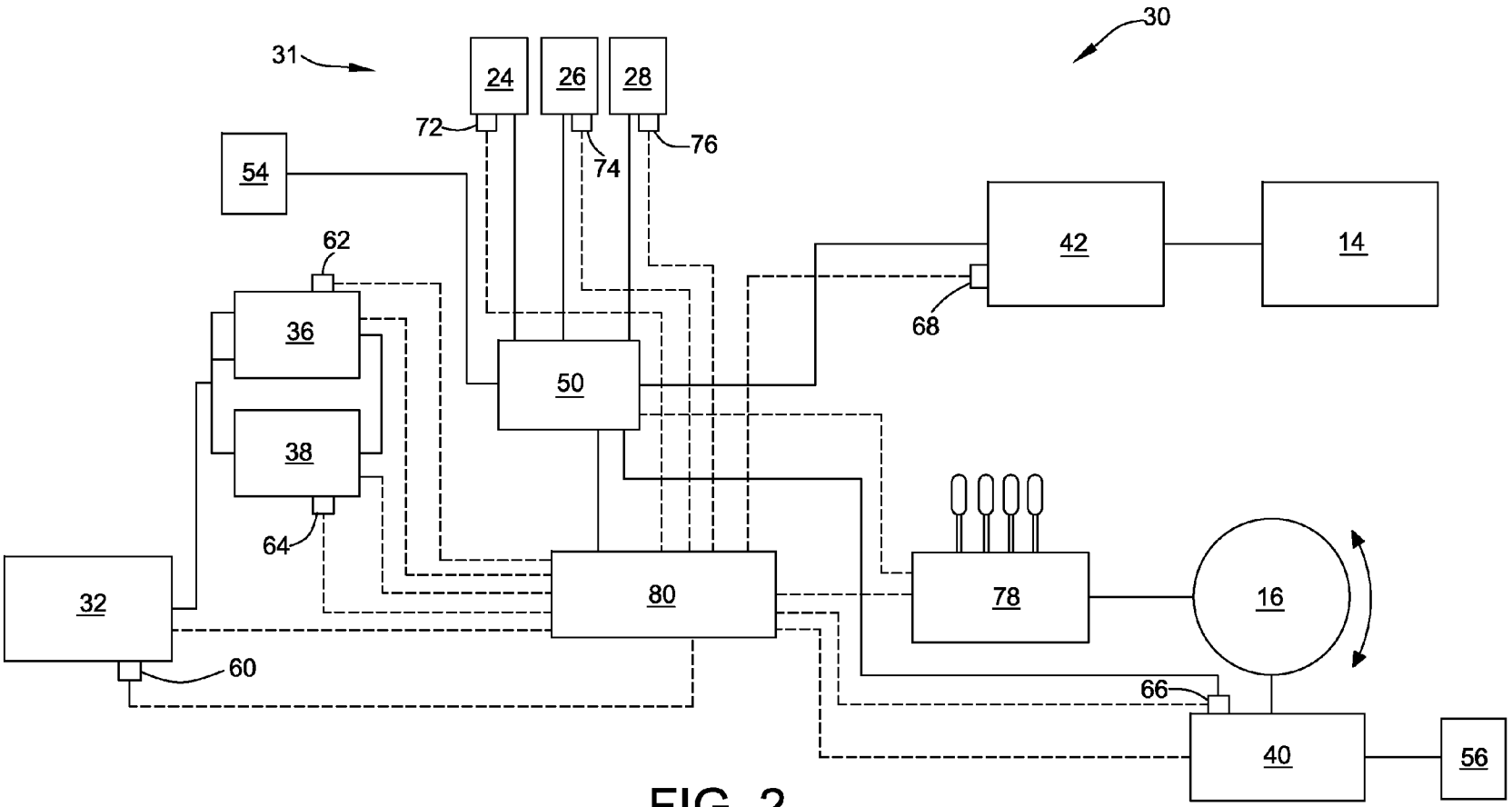
FIG. 2 is a schematic diagram of a machine power system according to the present disclosure.

Referring to FIG. 2, the machine 10 may include a power system 30 including a hydraulic system 31 having one or more hydraulic devices operated via one or more power sources. In particular, the illustrated power system 30 includes an internal combustion engine 32 as a power source. The engine 32 may be, for example, a compression-ignition engine, a spark-ignition engine, a gas turbine engine, a homogeneous-charge compression ignition engine, a two-stroke engine, a four-stroke, or any type of internal combustion engine known to those skilled in the art. The engine 32 may be configured to operate on any fuel or combination of fuels, such as, for example, diesel, bio-diesel, gasoline, ethanol, methanol, or any fuel known to those skilled in the art. Further, the internal combustion engine 32 may be supplemented or replaced by another power source such as a hydrogen-powered engine, fuel-cell, solar cell, and/or any power source known to those skilled in the art. For example, an electric motor/generator may be coupled to engine 32, such that engine 32 drives motor/generator, thereby generating electric power. Additionally, the power system may include one or more electric storage devices such as batteries and/or ultra-capacitors configured to store electric energy supplied from the motor/generator and/or or any electrical energy generated by capturing energy associated with operation of machine 10, such as energy captured from regenerative braking of moving parts of 10 machine, such as, for example, ground-engaging members 14 and/or rotation of cab 16.

The engine 32 may produce a rotational output having both speed and torque components. For example, the engine 32 may contain an engine block having a plurality of cylinders (not shown), reciprocating pistons disposed within the cylinders (not shown), and a crankshaft operatively connected to the pistons (not shown). The internal combustion engine may use a combustion cycle to convert potential energy (usually in chemical form) within the cylinders to a rotational output of a crankshaft. The maximum amount of power that the engine 26 can generate may depend on its engine speed. The engine 32 may have the potential to generate greater amounts of power when running at greater speeds.

The power or torque associated with the rotating crankshaft of engine 32 may be distributed to one or more hydraulic devices that can drive, for example, the work implement and/or the ground engaging members. In the exemplary embodiment shown in FIG. 2, the hydraulic devices include a pair of hydraulic pumps 36, 38 to which the engine 32 is coupled. The hydraulic pumps are, in turn, coupled to a hydraulic fluid source. While the hydraulic fluid source is not illustrated in FIG. 2, those of skill in the art will understand the inclusion of the same, as well as hydraulic lines coupling the various components of the hydraulic system 31. The hydraulic system 31 may also include hydraulic pumps 40, 42, that may be devoted, at least in part, to specific operations of the machine. For example, pump 40 may be provided for rotation the cab 16 relative to the chassis 12 when an operator commands a swing motion, and pump 42 may be provided for operation of the ground engaging members 14 when travel of the machine 10 is commanded. It will be appreciated that pumps 40, 42 in particular may operate as pumps and/or motors, particularly when operating in a hybrid hydraulic system. That is, for example, the pump 40 may operate as a motor when supplied with hydraulic fluid to cause rotational motion of the cab 16 relative to the chassis 12; conversely, when such a swing motion is no longer commanded, the inertia of the cab 16 relative to the chassis 12 may operate the pump 40 as a pump, providing hydraulic power to the power system 30, which may be stored in a hydraulic storage device (not shown) for later supply of hydraulic power and/or to provide hydraulic power to other the remaining pumps 36, 38, which may supplement power of engine 32. Similarly, the pump 42 may act as a motor when travel is commanded, and be capable of slowing and stopping the ground-engaging members 14 in a regenerative manner that results in hydraulic energy being generated that may be rerouted to provide hydraulic power to the power system 30, and similarly stored and/or otherwise utilized to supplement power of engine 32. For the purposes of this disclosure, however, such pumps/motors will be referenced as pumps.

While fixed displacement pumps may be utilized except where otherwise designated herein, in the illustrated embodiment, the pumps 36, 38, 40, 42 are variable displacement pumps. The pumps 36, 38, 40, 42 may be swashplate-type pumps and include multiple piston bores, and pistons held against a tiltable swashplate. The pistons may reciprocate in the bores to produce a pumping action as the swashplate rotates relative to the pistons. The swashplate may be selectively tilted relative to the longitudinal axis of the pistons to vary a displacement of the pistons within their respective bores. The angular setting of the swashplate relative to the pistons may be carried out by any actuator known in the art, for example, by a servo motor. Although the structure of the pumps 36, 38, 40, 42 is not illustrated in detail, those of skill in the art will appreciate the structure, which is known in the art. Further, although the exemplary embodiment shown includes four pumps 36, 38, 40, 42, a two pumps, or more than two pumps may be utilized. Similarly, although two pumps 36, 38 are illustrated as coupled to the engine 32, a single pump or more than two pumps may be used in this capacity as well.

In the exemplary embodiment shown in FIG. 2, the pumps 36, 38, are hydraulically coupled to control valves 50, such that the pumps 36, 38 supply pressurized fluid to control valves 50, which, in turn, control fluid flow to and from hydraulic devices of machine 10. For the purposes of this disclosure, the "control valves 50" may include one or more hydraulic valves that control and direct hydraulic flow to and from various hydraulic fluid connections. For example, as shown in FIG. 2, the control valves 50 are hydraulically coupled to the hydraulic actuators 24, 26, and 28, and pumps 40, 42, which, when supplied with pressurized fluid flow, operate to provide a swing motion to the cab 16 and drive ground-engaging members 14, respectively. Although a single hydraulic pump 42 is shown with regard to driving of the ground-engaging members 14, the power system 30 may include one or more hydraulic pumps, for example, one for each of the ground-engaging members 14.

According to some embodiments, the engine 32 may drive the power transforming devices, such as the hydraulic pumps 36, 38, 40, 42, through a transmission (not illustrated). The transmission may comprise a mechanical transmission having multiple gear ratios. The transmission may further include a torque converter. According to some embodiments, the transmission may be in the form of a continuously variable transmission. It should be understood that the present disclosure is applicable to any suitable drive arrangement between the engine and the pump.

The hydraulic system 31 may further include one or more relief valves to control or limit the pressure in the hydraulic system 31 or an associated device or passage. The pressure is relieved by allowing the pressurized fluid to flow through the relief valve, typically to a tank (not shown) so that it may be reused within the hydraulic system 31. Relief valves are normally closed and are typically designed or set to open at a predetermined set pressure or cracking pressure to protect the associated passage, device, or system from being subjected to pressures that exceed their design limits. When the set pressure is exceeded, the relief valve becomes the "path of least resistance" as the valve is forced open and a portion of the fluid is diverted through the auxiliary route. The relief valves may be of any appropriate design.

The embodiment of FIG. 2 includes a main or first relief valve 54 in association with the control valves 50, and a second relief valve 56, here, a swing relief valve, associated with the swing pump 40, although additional relief valves may be provided throughout the system. The respective set pressures of the first relief valve 54 and the second relief valve 56 are typically set during assembly of the hydraulic system 31 and the machine 10. Sensors may also be provided that are arranged and configured to monitor opening of the first relief valve 54 and the second relief valve 56.

According to some embodiments, the engine may drive the power transforming devices, such as the hydraulic pump, through a transmission. The transmission may comprise a mechanical transmission having multiple gear ratios. The transmission may further include a torque converter. According to some embodiments, the transmission may be in the form of a continuously variable transmission. It should be understood that the present disclosure is applicable to any suitable drive arrangement between the engine and the pump.

The power system 30 may also include one or more sensors for monitoring operation of the power system. For example, the power system may include a sensor 60 associated with the engine 32, for example, an engine speed sensor 60 configured and arranged to monitor a speed of the engine. Other sensors associated with the engine may include a mass air-flow sensor, an emissions sensor, a manifold pressure sensor, a turbocharger boost pressure sensor, and/or other engine-related sensors. Sensors 62, 64, 66, 68 may also be provided in association with the pumps 36, 38, 40, 42. Pump sensors 62, 64, 66, 68 may be configured and arranged to monitor the pressure or output flow rate of the associated pump, for example. Such a pressure sensor may be is arranged and configured to monitor the discharge pressure of the associated pump. When the pump is a variable displacement pump, a pump flow rate sensor may, for example, be arranged and configured to monitor the displacement of the pump. According to other embodiments including those using a fixed displacement pump, the pump flow rate sensor may be a speed sensor associated, for example, with the impeller of the pump. Sensors 72, 74, 76 may also be associated with the hydraulic actuators 24, 26, 28 to provide, active readings of the pressures developed in the respective hydraulic actuators 24, 26, 28. Each of the sensors 60, 62, 64, 66, 68, 72, 74, 76 may provide respective signals indicative of the associated reading to the controller 33.

The power system may include an operator interface 78 to be used by a machine operator for entering commands relating to one or more functions of the machine 10. The operator interface 78 may be arranged in the cab 16 of the machine 10 or alternatively it may be located remote from the machine 10. The operator interface 78 may include one or more control device such as, for example, levers, pedals, joysticks, switches, wheels and/or buttons for controlling the machine 10 and its functions. For example, with respect to the illustrated embodiment, the operator interface 78 may include lever inputs for one or more of directing movement of the boom, movement of the stick, movement of the bucket, rotation or swing of the cab on the chassis, and movement of the machine through the ground engaging members. The operator interface may also be configured to permit the operator to enter a desired power setting for the machine. For example, the operator interface may be configured to allow an operator to choose between high power, low power and/or economy settings.

The power system 30, as shown in FIG. 2, may include a controller 80 for managing the power system 30. During operation of the machine 10, the controller 80 may be adapted to receive and process information from the operator interface 78 and the various sensors 60, 62, 64, 66, 68, 72, 74, 76 relating to the operation of the machine 10. From information received, the controller 80 may also determine certain operations of the machine 10, such as whether the machine 10 is traveling, or whether the machine 10 is idling. The controller 80 may be further adapted to process the information it receives and to control operation of the engine 32 and/or one or more of the hydraulic pumps 36, 38, 40, 42. For example, the controller 80 may be configured to adjust the speed of the engine 32 by adjusting the fueling of the engine 32. Additionally, the controller 80 may be further configured to use adjustments in the displacement of the pumps 36, 38, 40, 42 to adjust the respective motion of the pump, pump flow rate and/or the pressure in the hydraulic system 31. As shown in FIG. 2, the controller 80 may be capable of communicating with components of power system 30, such as the engine 32, the pumps 36, 38, 40, 42 and the sensors 60, 62, 64, 66, 68, 72, 74, 76 via either wired or wireless transmission and, as such, controller 80 may be connected to or alternatively disposed in a location remote from the machine 10.

The controller 80 may include a processor (not shown) and a memory component (not shown). The processor may be microprocessors or other processors as known in the art. In some embodiments the processor may be made up of multiple processors. Instructions associated with the methods described may be read into, incorporated into a computer readable medium, such as the memory component, or provided to an external processor. In alternative embodiments, hard-wired circuitry may be used in place of or in combination with software instructions. Thus, embodiments are not limited to any specific combination of hardware circuitry and software.

The term "computer-readable medium" as used herein refers to any medium or combination of media that is non-transitory, participates in providing computer-executable instructions to a processor for execution facilitating performing a method, implemented by a programmable controller. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, or any other medium from which a computer or processor can read.

The memory component may include any form of computer-readable media as described above. The memory component may include multiple memory components.

The controller 80 may be a part of a control module may be enclosed in a single housing. In alternative embodiments, the control module may include a plurality of components operably connected and enclosed in a plurality of housings. In still other embodiments the control module may be located in single location or a plurality of operably connected locations including, for example, being fixedly attached to the machine 10 or remotely to the machine 10.

To provide allow for automatic reactive management of the power system, the controller 80 may be configured to adjust one or more operating parameters of the power system 30 based on information received by the controller 80 relating to the how the machine is being operated by the operator and/or information relating to the working cycle or operating conditions in which the machine is being operated. In particular, the controller 80 may be configured to receive operator commands from the operator interface 78 and then to perform calculations that relate the operator commands to desired operating parameters for the power system 30 based on the information about how the machine 10 is being operated and/or the information about the work cycle and/or operating conditions in which the machine 10 is operating. In doing so, the controller 80 may adjust upward or downward the commands entered by the operator through the operator interface 78. The controller 80 can then adjust the control of one or more aspects of the power system 30, such as the engine 32 or one or more of the pumps 36, 38, 40, 42, in accordance with the desired operating parameters. As explained further below, the operating parameters that the controller 80 may adjust may include the machine power limit, engine speed and displacement of one or more of the pumps. The pump displacement parameter can be further used by the controller 80 to control the pump pressure limits and/or the pump flows for the respective pumps.

The information received by the controller 80 relating to how the machine 10 is being operated may include information from which a skill level of the operator may be inferred. Such operator skill level information may include data regarding the frequency with which the first and/or second relief valves 54, 56 in the system are operated that may be provided to the controller 80 by associated sensors. Alternatively, to the extent that the controller 80 makes adjustments to the operator's commands to prevent the opening of the first and/or second relief valves 54, 56, the controller 80 can consider operator skill level information by monitoring the frequency at which such adjustments are made. Excessive opening of one of the relief valves 54, 56 or the entering of commands that would, without intervention by the controller 80, result in the operation of one of the relief valves 54, 56 can be an indication of an inexperienced operator. If the controller 80 determines from the operator skill level information that the operator has a relatively lower level of skill, the controller 80 may reduce the maximum performance capacity of the power system 30 to reduce fuel consumption.

The information relating to the work cycle and/or operating conditions in which the machine 10 is operating received by the controller 80, referred to herein as machine utilization information, may include information about the machine load factor and information about the operator commands entered through the operator interface 78. More particularly, in considering the machine utilization information, the controller 80 may monitor how often the operator is using partial lever commands, for example commands at less than full displacement of the respective control device, to direct operations of the machine 10. The controller 80 may be configured to calculate a load factor for the machine 10 by dividing the current machine power by a reference machine power, such as the machine's rated power. The current machine power may be determined based on commands entered by the operator through the operator interface 78 as well as any adjustments made to the operator requested machine power made by the controller 80. If the load factor of the machine 10 is low and/or the operator is using partial lever commands extensively it can be an indication that the machine 10 is performing a relatively easy operation, such as digging in soft ground, and the controller 80 can be configured to reduce the maximum performance capability of the power system 30 in order to reduce fuel consumption based on such machine utilization information.

Other information that the controller 80 may be adapted to receive and use to help determine the desired power system operating parameters include information relating to the status of the machine 10 such as, for example, machine idle status and machine diagnostics. The controller 80 may also be adapted to receive and use information relating to the engine performance status including, for example, the engine transient and steady state torque capability and other engine diagnostic information. The controller 80 may calculate the transient and steady state torque capability of the engine based on engine speed, boost pressure, mass airflow sensors, inlet manifold temperature and various other internal engine control variables. The controller 80 also may be adapted to receive and use information relating to the performance status of the hydraulic pumps 36, 38, 40, 42 including information relating to the current pump displacements and pressures.

The operator interface 78 may be configured with a kick-out control device (e.g., a switch or button) that allows an operator to de-activate the adjustment of the power system 30 operating parameters performed by the controller 80 based on the information relating to the operator skill level and/or the machine work cycle or working environment. This kick-out switch may be used by an operator in situations where the operator desires the machine 10 to respond in a particular manner without any adjustments performed by the controller 80. For example, the controller 80 may be configured such that when the kick-out is activated by the operator, the controller 80 sets the power system 30 to a defined set of operating parameters (e.g., machine power limit, engine speed, pump displacement). For example, when the kick-out is activated, the controller 80 may set the power system 30 to the maximum machine power limit, engine speed and hydraulic pressure (which may be controlled via pump displacement).

INDUSTRIAL APPLICABILITY

Figure 3:
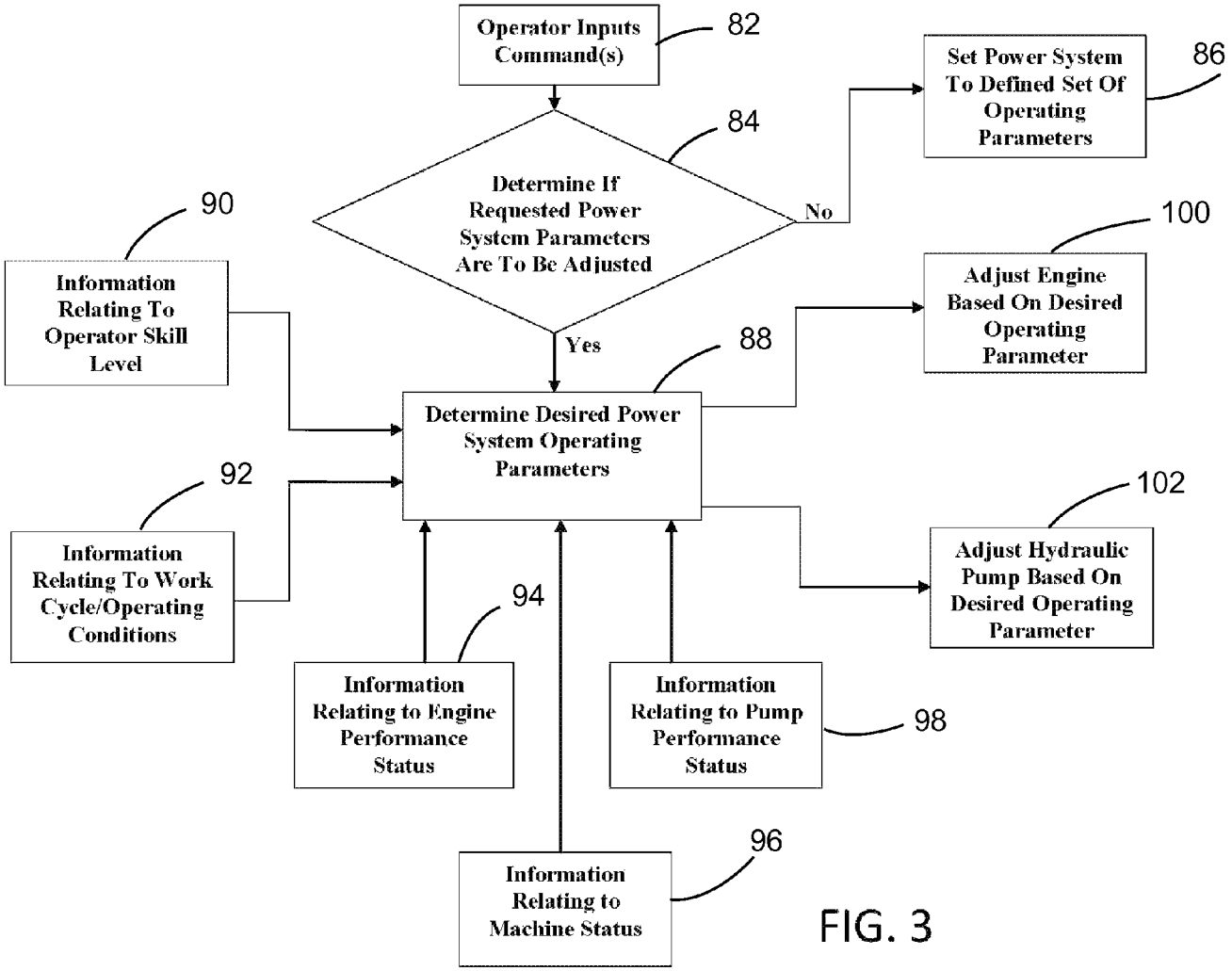
FIG. 3 is a flow chart illustrating one method of managing a machine power system according to the present disclosure.

Referring to FIG. 3 of the drawings, a schematic flow diagram is provided that includes various steps that may be implemented by the controller 80 to manage the power system 30. In a first step 82, an operator may input commands through the operator interface 78. These commands may include directing movement of the machine 10 or machine implement 22. For example, with respect to the illustrated embodiment, the operator may enter commands directing movement of one or more of the boom 18, stick 20, bucket 22, cab 16 or ground engaging members 14. The commands inputted by the operator via the operator interface 78 may also include a desired power setting such as, for example, high power, low power or economy power.

The next step 84 is a decision step in which it is determined whether the controller 80 will proceed with performing any adjustments to the operator requested power system operating parameters. If, for example, the kick-out is activated, the controller 80 does not proceed with any adjustments and instead proceeds to step 86 where the power system 30 is set to a defined set of operating parameters. Another example of a circumstance where the controller 80 would not proceed with adjustments to the requested power system operating parameters would be if the machine 10 was in a travel mode.

If the controller 80 determines that there are not any reasons to not proceed with adjustments to the requested power system operating parameters, then the method can proceed to step 88 where such adjustments are made so as to determine desired power system operating parameters (e.g., machine power limit, engine speed, pump displacement, pump flow or pressure). The controller 80 may determine the desired power system operating parameters based on a number of different types of information. As shown in step 90 of FIG. 3, information relating to the operator skill level may be communicated to the controller 80 for use in determining the desired power system operating parameters. As described above, this information can include data relating to the frequency with which one or both of the first and second relief valves 54, 56 are opening. If the controller 80 determines that the operator has a lower skill level, the controller 80 may adjust the operator requested power system operating parameters downward when determining the desired power system operating parameters. Such a downward adjustment is based on information showing that operators with lower skill levels tend to request more machine power than is necessary for a given task.

In step 92 of FIG. 3, machine utilization information relating to the work cycle being performed by the machine 10 or the conditions in which the machine 10 is operating is communicated to the controller 80 for use in determining the desired power system operating parameters. This information may include data relating to the machine load factor and/or data relating to the operator commands entered through the operator interface 78. If the controller 80 determines that the machine load factor is low or that commands at less than full displacement of the respect control device are being used often, the controller 80 may adjust the operator requested power system operating parameters downward when determining the desired power system operating parameters in order to reduce fuel consumption because the machine 10 may be performing a relatively easy task such as digging in soft dirt. Conversely, if the machine load factor is high, the controller 80 may adjust the desired power system operating parameters upward.

In step 94, information relating to the engine performance status is input to the controller 80 for use in determining the desired power system operating parameters. As noted above, this can include information relating to the transient and steady state torque capability of the engine 32 such as from the engine speed sensor 60 and the other engine sensors. If the controller 80 determines that either the transient or steady state torque capability of the engine 32 are insufficient for acceptable machine 10 operation, the desired engine speed may be adjusted upward by the controller 80.

Information relating to the machine status is input to the controller 80 to the controller for possible use in determining the desired power system operating parameters in step 96. This information may include machine diagnostic information or information on the machine idle status. In step 98, information relating to the pump performance status is input to the controller 80 for possible use in determining the desired power system operating parameters. This information may include information relating to the current displacements and/or pressures of one or more of the pumps 36, 38, 40, 42 from the respective pump flow rate sensors 62, 64, 66, 68 and/or the pressure sensors 72, 74, 76.

In step 88, the controller 80 may determine the desired adjusted power system operating parameters based one or more of the sets of information communicated to the controller in steps 90, 92, 94, 96, 98. Once these desired parameters are determined, they may be used to adjust the engine 32 in step 100. For example, the adjustment may be an adjustment to the machine power limit or to the engine speed. The desired engine speed may be determined by the controller 80 using one or more of: a minimum engine speed for maintaining a sufficient transient or steady state torque capability for acceptable machine operation; the requested machine power based on commands entered via the operator interface 78; the requested pump flow for one or more of the pumps 36, 38, 40, 42 based on commands entered via the operator interface 78; and a minimum speed for acceptable engine performance.

In step 102, the desired power system operating parameters may be used to adjust one or more of the hydraulic pumps 36, 38, 40, 42. For example, the adjustment may be an adjustment to the desired pump displacement which, in turn, can be used to control the pressure limit and flow of the respective pump. The desired pump displacement may be determined based on one or more of: the requested hydraulic flow as entered through the operator interface 78; the current pump pressures and flows; and a pump displacement limit based on the power setting (e.g., high power, low power or economy) input by the operator of the machine 10 through the operator interface 78. This displacement limit is a function of the target machine power limit and the pump discharge pressure.

In order to minimize operator awareness of the adjustments being performed by the controller in determining the desired power system operating parameters in step 88, the controller 80 may be adapted to delay implementation of the adjustment of the pumps 36, 38, 40, 42 or the engine 32 based on the desired power system operating parameters by, for example, utilizing a de-bounce timer and/or a rate-of-change limit when determining the desired power system operating parameters. This can slow the application of the changes on machine performance executed by the controller 80 so that they are not as noticeable to an operator such as through changes in engine noise or in the feel of the machine 10. The de-bounce timer and/or rate limit may also provide a "peak shaving" approach to power management in that the machine 10 may not react to temporary power or speed change requests made by an operator via the operator interface 78. This can lead to reduced fuel consumption.

The present disclosure is applicable to the power system of any operator directed machine having a power source. The present disclosure is particularly applicable to such machine power systems in which the power source that drives a hydraulic device such as a hydraulic pump or motor. However, the present disclosure is not limited to such machine power systems. For example, the present disclosure may also be applicable to any vehicle. In particular, the principles of the present disclosure could be used to provide a vehicle with a power system in which the power system performance could be increased or reduced based on a determination of the driver's skill level and/or a determination of the conditions in which the vehicle is traveling.

With respect to working machines, the present disclosure can provide significant fuel savings by automatically reducing the performance of the power system when the machine is being operated by a less skilled operator or when the machine is being used in a less demanding work cycle or working environment. For example, it has been found that less skilled operators rarely shift the power system out of the highest power mode regardless of the work that is being performed. However, in many circumstances, the highest power mode is not necessary to adequately perform the work the machine is undertaking. In such cases, the operator requested power does not match the intended utilization of the machine resulting in a waste of fuel as well as increased wear on the machine components and strain on the machine operator. The present disclosure allows the power system to automatically react to the operator's skill level and/or the working environment and thereby identify those situations where the machine power can be reduced in order to save fuel and reduce wear on the machine.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A power system for a machine, the power system comprising:

an operator interface for entering an operator command relating to one or more functions of the machine;

a hydraulic pump;

an engine configured to provide power to the hydraulic pump; and a controller in communication with the operator interface, the hydraulic pump and the engine, the controller being configured to:

consider operator skill level information relating to a skill level of the operator of the machine, determine at least one desired power system operating parameter based on the operator command and the operator skill level information, apply a rate of change limit on the determination of the at least one desired power system operating parameter, and adjust at least one of the hydraulic pump or the engine based on the at least one desired power system operating parameter.

2. The system of claim 1 wherein the controller is configured to consider machine utilization information relating to utilization of the machine and to determine the at least one desired power system operating parameter based on the operator command, the operator skill level information and the machine utilization information.

3. The system of claim 2 wherein the machine utilization information includes a machine load factor.

4. The system of claim 2 wherein the machine utilization information includes data relating to the operator command entered via the operator interface.

5. The system of claim 1 wherein the controller is configured to consider engine performance status information and to determine the at least one desired power system operating parameter based on the operator command, the operator skill level information and the engine performance status information.

6. The system of claim 5 wherein the engine performance status information includes a torque capability of the engine.

7. The system of claim 1 wherein the hydraulic pump communicates with a hydraulic system including a relief valve and wherein the operator skill level information includes a frequency that the relief valve operates.

8. The system of claim 1 wherein the operator interface includes a kick-out control device and wherein the controller is configured to stop adjusting the at least one of the hydraulic pump or the engine based on the desired power system operating parameter and to instead adjust the at least one of the hydraulic pump or the engine based on a predetermined power system operating parameter when the kick-out control device is actuated.

9. The system of claim 1 wherein the desired power system operating parameter is at least one of a machine power limit, an engine speed, or a hydraulic pump displacement.

10. The system of claim 1 wherein the controller is configured to apply a timer before determining the at least one desired power system operating parameter and adjusting the at least one of the hydraulic pump or the engine based on the at least one desired power system operating parameter.

11. A method for managing a power system of a machine, the method comprising:

receiving an operator command through an operator interface;

collecting information relating to a skill level of an operator of the machine;

determining at least one desired power system operating parameter based on the operator command and the operator skill level information; and adjusting an engine or hydraulic device of the power system based on the at least one desired power system operating parameter, wherein the hydraulic device communicates with a hydraulic system including a relief valve, and wherein the operator skill level information includes a frequency that the relief valve operates.

12. The method of claim 11 further including collecting machine utilization information relating to utilization of the machine and where the determining of the at least one desired power system operating parameter is based on the operator command, the operator skill level information and the machine utilization information.

13. The method of claim 12 wherein the machine utilization information includes a machine load factor.

14. The method of claim 11 further including collecting engine performance status information and wherein the determining of the at least one desired power system operating parameter is based on the operator command, the operator skill level information and the engine performance status information.

15. The method of claim 14 wherein the engine performance status information includes a torque capability of the engine.

16. The method of claim 11 further including:

determining whether a kick-out control device has been activated;

stopping adjustment of the engine or the hydraulic device based on the at least one desired power system operating parameter; and adjusting the engine or the hydraulic pump based on a predetermined power system operating parameter.

17. The method of claim 11 wherein the at least one desired power system operating parameter is at least one of a machine power limit, an engine speed, or a hydraulic pump displacement.

18. A machine comprising:

an operator interface for entering operator commands relating to one or more functions of the machine;

a work implement;

a hydraulic device for driving movement of the work implement;

an engine configured to provide power to the hydraulic device; and a controller in communication with the operator interface, the hydraulic device and the engine, the controller being configured to:

consider operator skill level information relating to a skill level of an operator of the machine, consider machine utilization information relating to utilization of the machine, determine at least one desired power system operating parameter based on the operator commands, the operator skill level information and the machine utilization information, apply a rate of change limit on the determination of the at least one desired power system operating parameter, and adjust at least one of the hydraulic device or the engine based on the at least one desired power system operating parameter.

* * * * *